US005871349A

United States Patent [19]

Johnson et al.

[11] Patent Number: 5,871,349

[45] Date of Patent: Feb. 16, 1999

[54] ROTARY VALVE THERMAL OXIDIZER

[75] Inventors: Jeffrey C. Johnson, Beverly Hills, Mich.; Thomas J. Truppi, Corona, Calif.; Erwin Hendricks, La Verne, Calif.; Theodore R. Wheeler, Los Alamitos, Calif.

[73] Assignee: Smith Engineering Company, Ontario, Calif.

[21] Appl. No.: 951,801

[22] Filed: Oct. 16, 1997

[51] Int. Cl.[6] ..... F23L 15/02; F27D 17/00

[52] U.S. Cl. ..... 432/180; 165/9; 165/7

[58] Field of Search ..... 432/179, 180, 432/181; 422/173; 165/4, 7, 9; 110/246, 247, 254; 122/1 A

[56] References Cited

U.S. PATENT DOCUMENTS

| | | | |
|---|---|---|---|
| 1,970,534 | 8/1934 | Colby et al. . | |
| 3,509,834 | 5/1970 | Rosenburg et al. . | |
| 3,664,413 | 5/1972 | Bo | 165/9 |
| 3,718,440 | 2/1973 | Foster-Pegg | 165/9 |
| 4,126,419 | 11/1978 | Katabuchi et al. | 165/4 |
| 4,173,252 | 11/1979 | Sakaki et al. | 165/9 |
| 4,280,416 | 7/1981 | Edgerton | 165/7 |
| 5,016,547 | 5/1991 | Thomason | 165/7 |
| 5,026,277 | 6/1991 | York | 432/181 |
| 5,352,115 | 10/1994 | Klobucar | 432/181 |
| 5,460,789 | 10/1995 | Wilhelm | 422/173 |
| 5,529,113 | 6/1996 | Borowy | 165/9 |
| 5,562,442 | 10/1996 | Wilhelm | 432/180 |
| 5,628,968 | 5/1997 | Hug et al. | 422/173 |
| 5,700,433 | 12/1997 | Somary . | |

*Primary Examiner*—Theresa J. Walberg
*Assistant Examiner*—Gregory A. Wilson
*Attorney, Agent, or Firm*—Niro, Scavone, Haller & Niro

[57] ABSTRACT

A rotary valve thermal oxidizer including an interfacial seal disposed between rotating and fixed valve portions to prevent the mixing of treated and untreated gas streams. In a preferred embodiment, the valve sealing device includes a flowable sealing material contained within a receptacle, and contacted by a partition nested within the receptacle. Other sealing devices, as well as purge and/or sealing gases, may be employed to prevent leakage, while avoiding the use of machined parts.

20 Claims, 8 Drawing Sheets

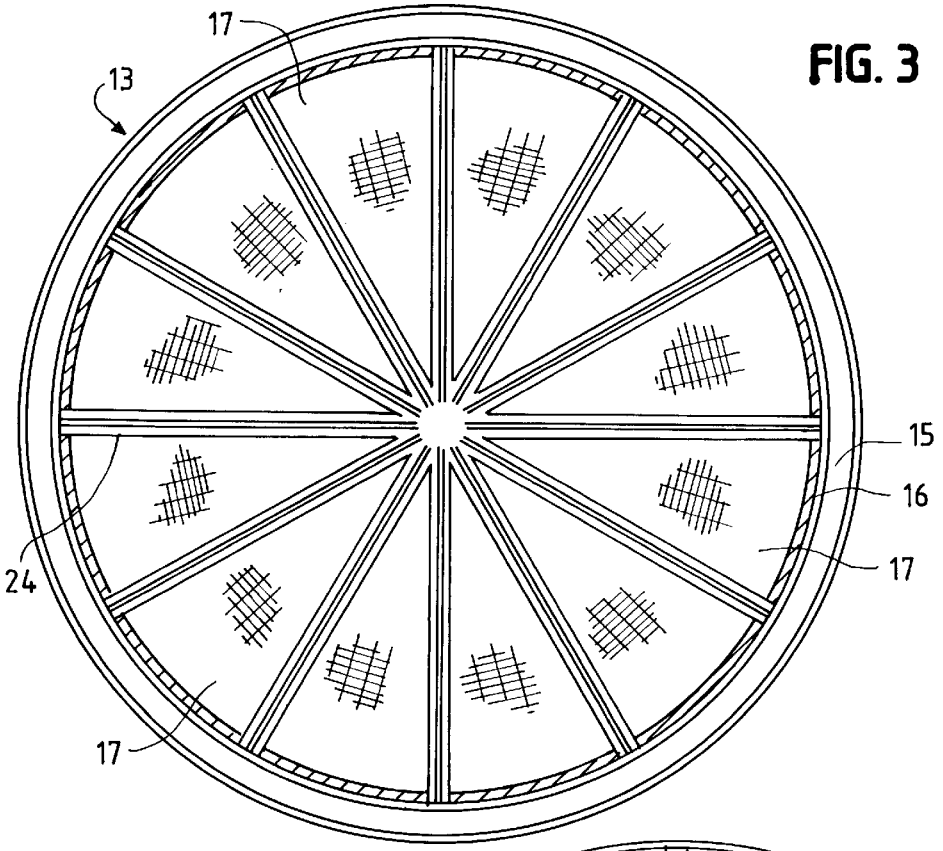
FIG. 3
FIG. 4
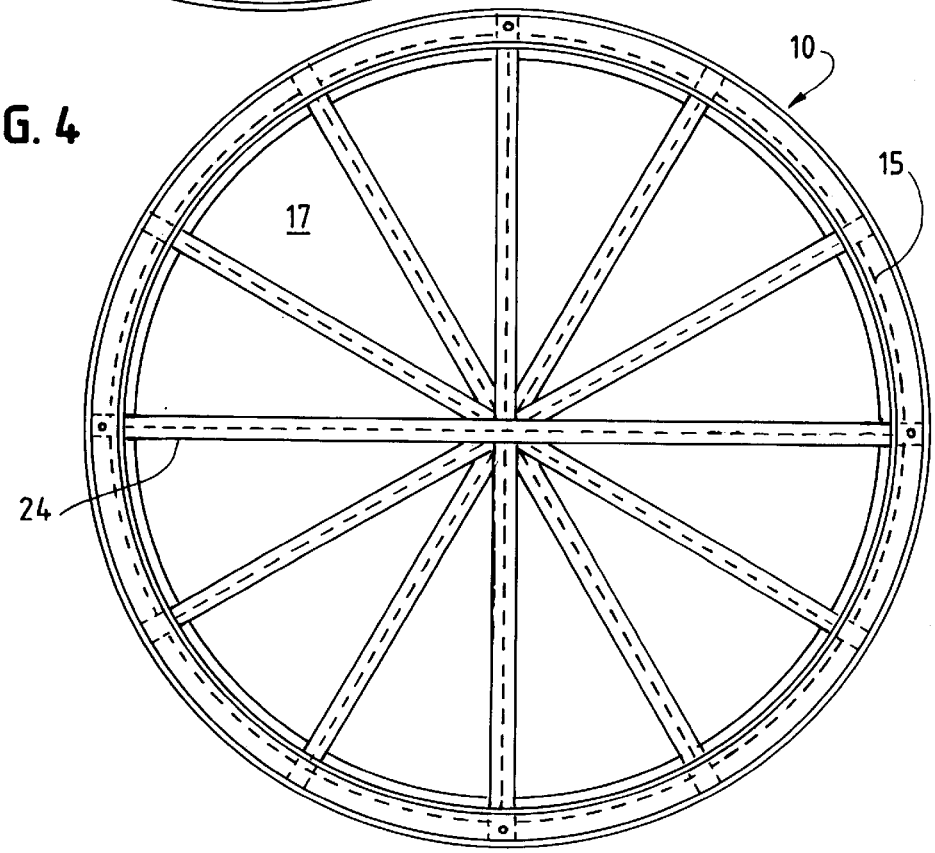

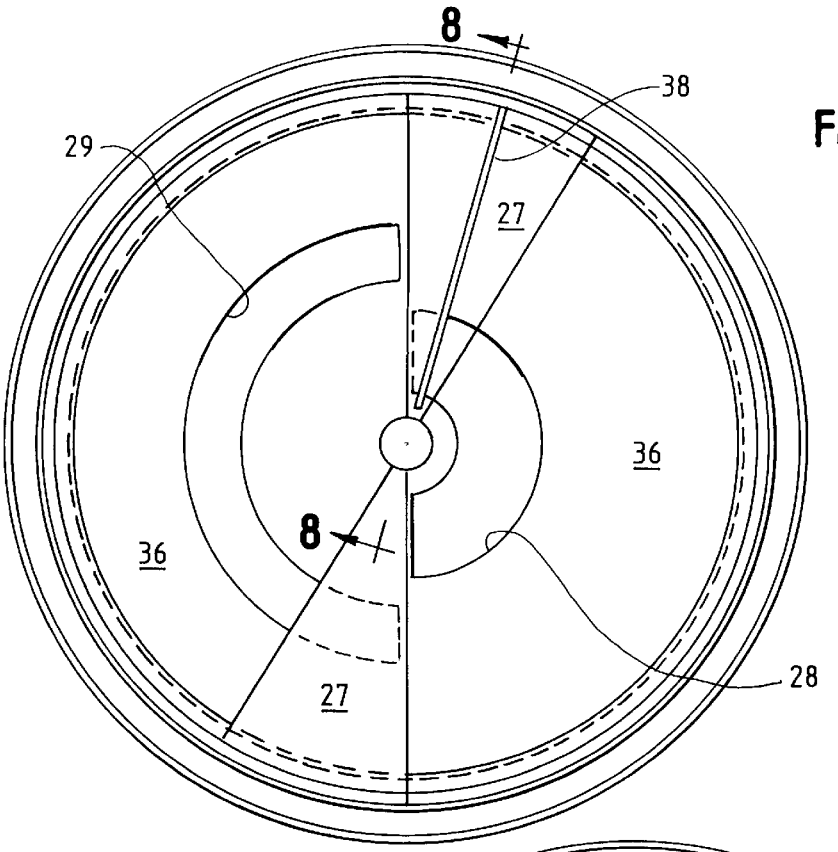
FIG. 5
FIG. 6
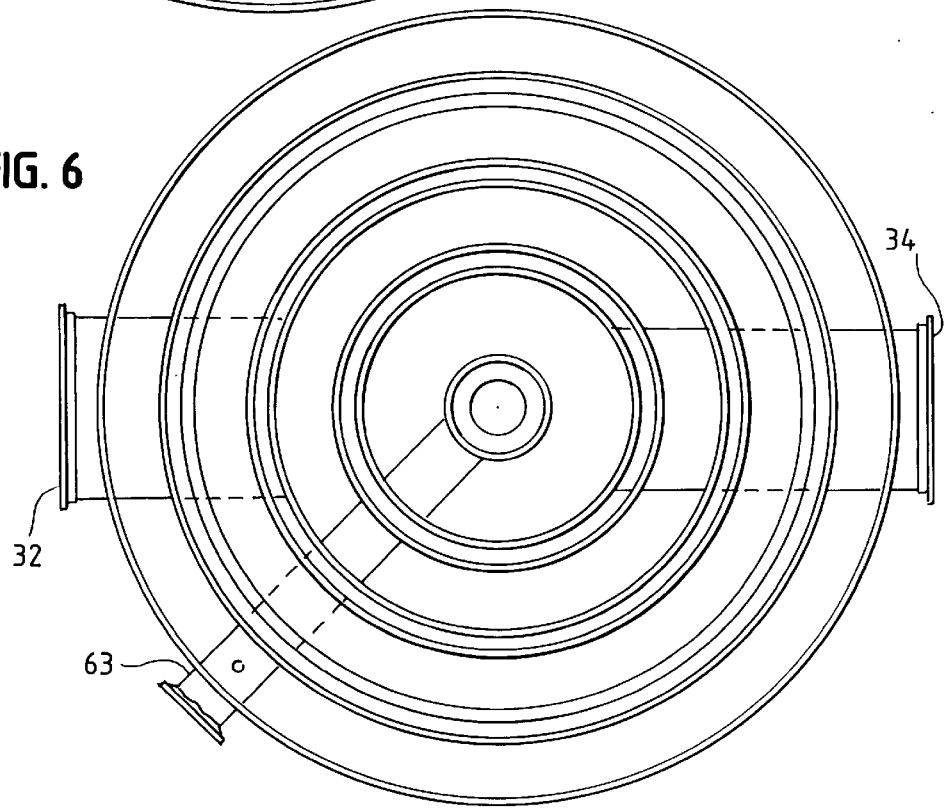

ROTARY VALVE THERMAL OXIDIZER

BACKGROUND OF THE INVENTION

This invention generally relates to multi-chambered thermal oxidizers that employ a rotary valve. More specifically, the invention relates to sealing apparatus used with such devices for preventing the unwanted mixing of treated and untreated gases.

Thermal oxidizers such as regenerative thermal oxidizers (RTOs) are known (see, e.g., U.S. Pat. Nos. 5,026,277 and 5,352,115), and are used for oxidizing pollutants, such as hydrocarbon vapors in air. In a conventional "reverse flow" RTO, a pollutant-laden gas to be cleaned is directed through a first "hot" heat exchanger and then into a combustion chamber; the oxidized gas is then directed out of the combustion chamber and through a second "cool" heat exchanger. This flow through the heat exchanging beds is then reversed. By alternating the flow of cool gas to be cleaned through the "hot" heat exchanger, and moving the hot cleaned gas from the combustion chamber and through the "cool" heat exchanger, an RTO can continuously operate to efficiently oxidize pollutant-laden gases.

Manufacturers always seek higher destruction efficiencies for thermal oxidizers, while balancing the costs toward obtaining this goal against fabrication and use costs. The destruction efficiency of an RTO is dependent, in part, on the effectiveness of the valve seals in preventing the untreated, pollutant-laden process stream from exiting the exhaust stack without first passing through the combustion chamber. With conventional, multi-bed RTOs, multiple poppet and butterfly valves and/or diverter dampers are used, which typically employ either a tadpole or metal-to-metal seat.

Rotary valve, "single-can" RTOs have also become commercially available. These are multi-chamber thermal oxidizers that employ a rotary valve assembly, as shown in U.S. Pat. Nos. 4,280,416 to Edgerton, 5,016,547 to Salem and 5,460,789 to Eisenmann. Rotary valve RTOs have several advantages over conventional RTOs. They can be made more economically, and do not require multiple butterfly or poppet valves. Also, rotary valve RTOs provide a smoother flow of the process gas through the device than conventional RTOs, since there are lower pressure fluctuations in the process duct work as a result of the absence of abrupt flow reversals.

Rotary valve RTOs present a new and different sealing problem, however, since sealing must be accomplished across the interface of the rotating and fixed valve portions, to avoid unwanted mixing of the untreated and treated gas streams. Rotary valve RTOs have used either a metallic wiper seal and/or a close-tolerance (machined) gap seal to minimize leakage between the fixed and rotating portions of the device, with or without the use of "sealing" or "purge" gas. There are disadvantages to each of these approaches.

With a "wiper" seal design, a wear surface is placed on a fixed portion of the valve while the rotating section is allowed to make sliding contact with the wear surface. However, the wear surface eventually needs to be replaced. Also, the nature of the valve design and the placement of flow passages make it difficult to access the inner sealing surfaces for repair or replacement.

A close-tolerance seal may also be used, but it is difficult and expensive to fabricate, particularly with the large valves used in RTO applications, which may be 5–12 feet in diameter. Since a precisely-machined valve seal is difficult to achieve, past rotary valve devices have also used a volume of clean, pressurized "sealing" or "purge" gas to minimize cross-contamination.

As used here, "purge" gas refers to a clean gas used to displace untreated vapors in the oxidizer bed, while "sealing" gas refers to a separating clean air curtain provided at a higher pressure than the process stream, to prevent one gas from mixing with another adjacent gas. As used here, purge gas under either negative (vacuum) or positive pressure may be employed.

As discussed below, a primary advantage of the present invention is realized through the use of a "sand seal". Sand seals have long been used in kiln applications as a draft seal. However, it is not believed known to use a sand seal in connection with a rotary valve thermal oxidizer.

Accordingly, it would be advantageous to provide a more efficient yet economical rotary valve thermal oxidizer that employs superior valve sealing devices.

SUMMARY OF THE INVENTION

These and other objects are achieved by the present invention, which preserves the advantages of existing rotary valve thermal oxidizers, while overcoming disadvantages associated with such devices and also providing new advantages.

In a preferred embodiment, a regenerative thermal oxidizer is provided, and includes a combustion chamber, and a heat exchanger with a plurality of heat exchanging segments that communicate with the combustion chamber. A gas stream distribution assembly is also provided, and includes a fixed plenum having an untreated gas stream inlet and a treated gas stream outlet, and a rotating plenum disposed between the fixed plenum and the heat exchanger. The rotating plenum permits the conveyance of the untreated gas stream from the inlet to selective heat exchanger segments, and also permits the conveyance of the treated gas stream from other selective heat exchanger segments to the outlet.

An interfacial seal is disposed at an interface between the fixed and rotating plenums to reduce mixing of the treated and untreated gases. This seal includes at least one annular receptacle containing a sealing material and a partition, which may be cylindrical, nested within the receptacle and engaging the sealing material. In preferred embodiments, the partition may be associated with the rotating plenum and the receptacle may be associated with the fixed plenum. Conversely, the partition may be associated with the fixed plenum and the *receptacle may be associated with the rotating plenum. Preferably, to minimize pressure fluctuations, the rotating plenum moves continuously with respect to the fixed plenum.

The sealing material for the interfacial seal is substantially inert with respect to the treated and untreated gas streams, and is generally free-flowing. In a preferred embodiment, the sealing material is composed of particles having a size sufficient to minimize agglomeration of the particles when exposed to gas streams having an elevated moisture content. Preferably, the seal employs components that are not machined, and the sealing material is composed of particles, such as sand or glass beads, having a maximum particle size sufficient to substantially prevent passage of the gas stream.

The RTO of the present invention reduces the leakage of the untreated gas through the interfacial seal to less than about 0.1% or, more preferably, 0.05%, of the total flow through the RTO, based upon testing in which there was 30 inches of water column differential pressure between the inlet and outlet gas stream.

In a preferred embodiment, the heat exchanger segments are defined by radial walls, and the rotating plenum includes a gas flow obstruction assembly having a diametric partition. Radially extending seals, such as metallic wiper blades, depend from the radial walls and are in wiping engagement with the diametric partition.

The rotating plenum may have a circumferential outer wall with a peripheral lip, and a circumferential sliding seal, such as a spring steel seal, may be used to engage the peripheral lip and to prevent untreated gas from leaking outside the peripheral interface of the rotating and fixed plenums.

A purge gas/sealing gas passageway may also be provided, and communicates with a portion of the rotating plenum, so that a separating gas curtain flows through selective heat exchanger segments both to purge them, and to prevent intermixing between adjacent treated and untreated gas streams. Purge gas may be supplied under either positive or negative (vacuum) pressure.

While the preferred embodiment has been disclosed in the context of an RTO, those of ordinary skill in the art will understand that the rotary valve thermal oxidizer of the present invention may be used in other forms, such as with catalytic thermal oxidizers.

BRIEF DESCRIPTION OF THE DRAWINGS

The novel features which are characteristic of the present invention are set forth in the appended claims. The invention itself, however, together with further objects and attendant advantages, will be best understood by reference to the following description taken in connection with the accompanying drawings, in which:

FIG. 3 is a sectional view along reference line 3—3 of FIG. 2;

FIG. 4 is a sectional view along reference line 4—4 of FIG. 2;

FIG. 5 is a sectional view along reference line 5—5 of FIG. 2;

FIG. 6 is a sectional view along reference line 6—6 of FIG. 2;

DETAILED DESCRIPTION OF THE PREFERRED EMBODIMENTS

Figure 1:
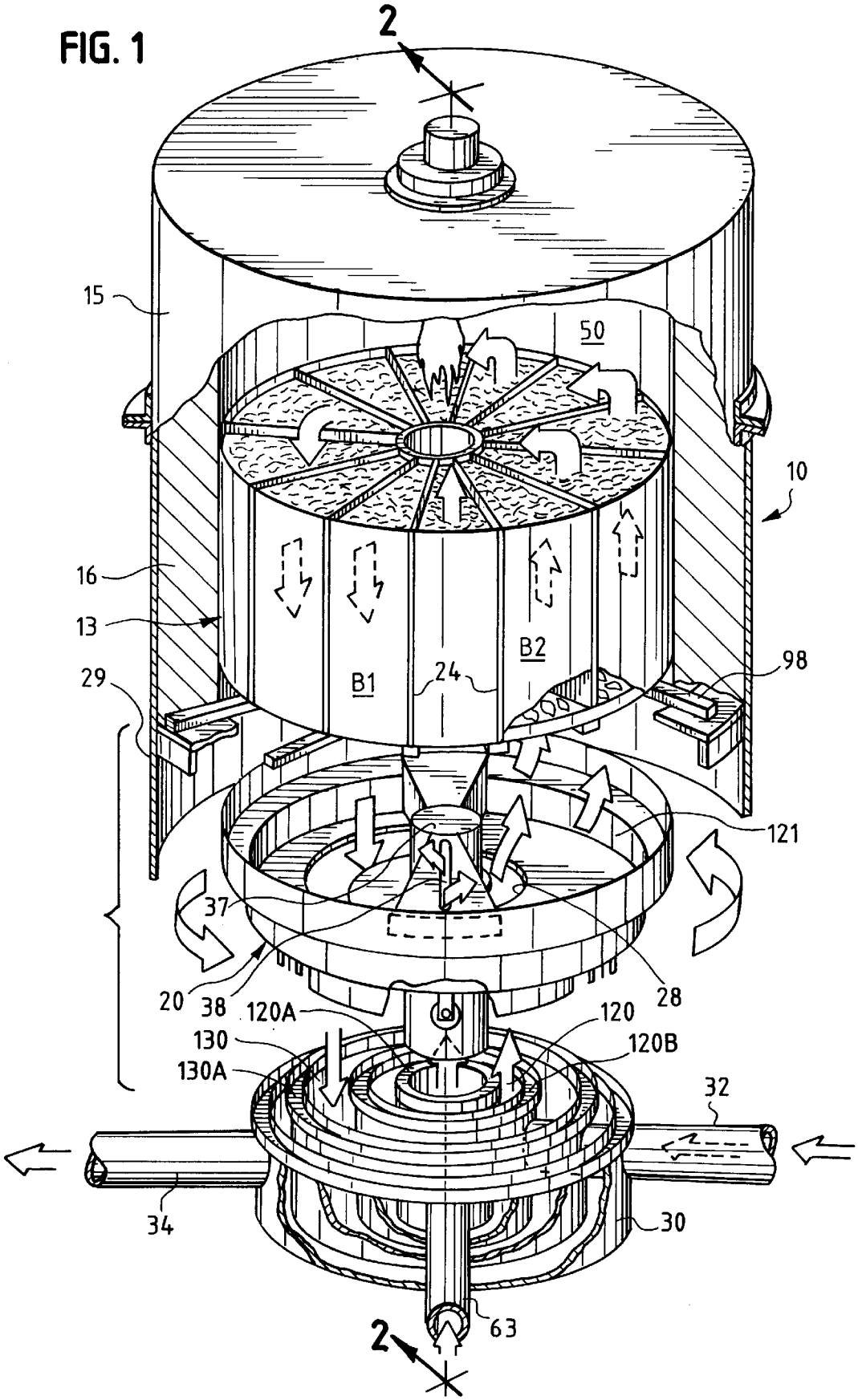
FIG. 1 is a perspective view of a preferred embodiment of the present invention.

Referring first to FIG. 1, a preferred embodiment of the present invention, an RTO, is shown and generally designated with the reference numeral 10. RTO 10 includes a heat exchanger, generally designated as 13, located within a reactor housing 15, surrounded by bed housing 16, and supported by media beam 98. Combustion chamber 50 is located above heat exchanger 13, adjacent burner 12. Access doors 92, 93 are also provided.

Referring to FIGS. 1, 3 and 4, in the preferred embodiment, heat exchanger 13 includes twelve radial walls 24 which run vertically through the heat exchanger, dividing it into twelve radially segmented or "pie-shaped" sections 17 which contain appropriate heat exchange media, and through which gas flows. Of course, a lesser or greater number of heat exchanger sections may be employed, but this number has been found to provide an appropriate balance between fabrication costs and the provision of a maximum useable surface area for the heat exchanging beds.

A gas stream distribution assembly is located below heat exchanger 13, and includes rotating and fixed plenums, generally designated as 20 and 30, respectively. An untreated gas stream containing pollutants such as hydrocarbons flows into inlet duct 32 of fixed plenum 30, and then through rotating plenum 20 into heat exchanger 13. After oxidation, typically at temperatures of 1500° or greater, the purified gas stream exits through rotating plenum 20, and through exhaust duct 34 of fixed plenum 30, as shown by the arrows. At any one time, five heat exchanger sections 17 (B2 of heat exchanger 13) are always communicating with the inlet gas stream, while five sections 17 (B1 of heat exchanger 13) communicate with the exhaust gas stream.

Rotating plenum 20 is continuously rotated about central shaft 37A in timed relationship with (non-rotating) heat exchanger 13 and with the rate of flow of the process gas so that selective radially segmented sections 17 which receive polluted process gas are maintained at an appropriately high temperature, allowing "regeneration" to occur and increasing the efficiency of the incineration system of the RTO.

Figure 16:
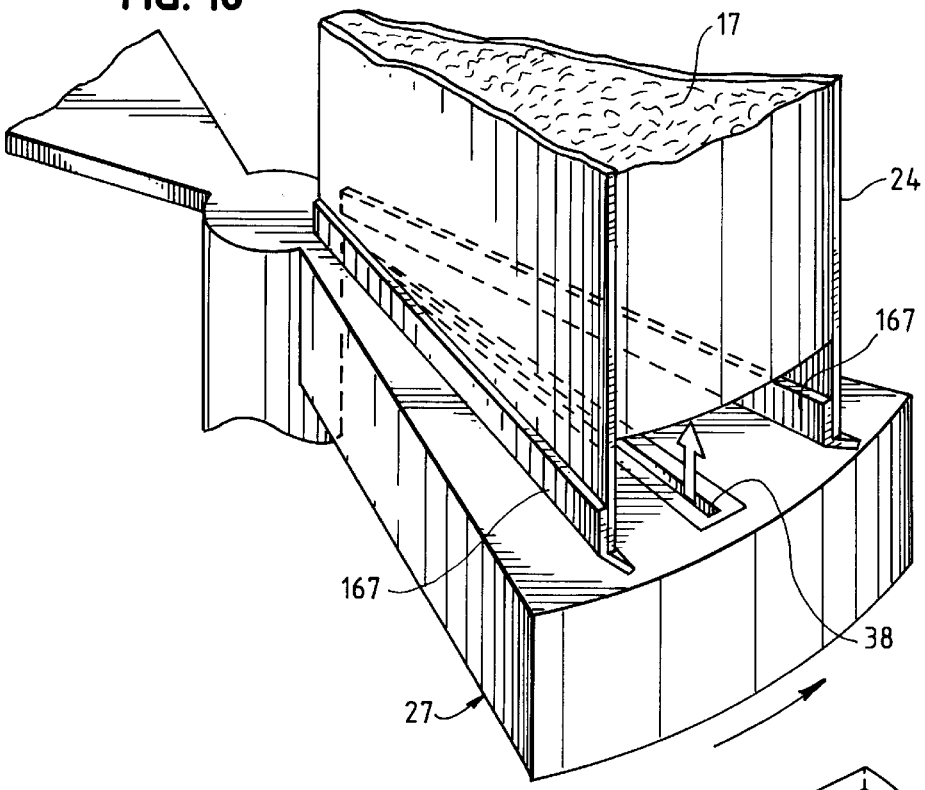
FIG. 16 is a partial perspective view of the wiper seals and associated structure.
Figure 17:
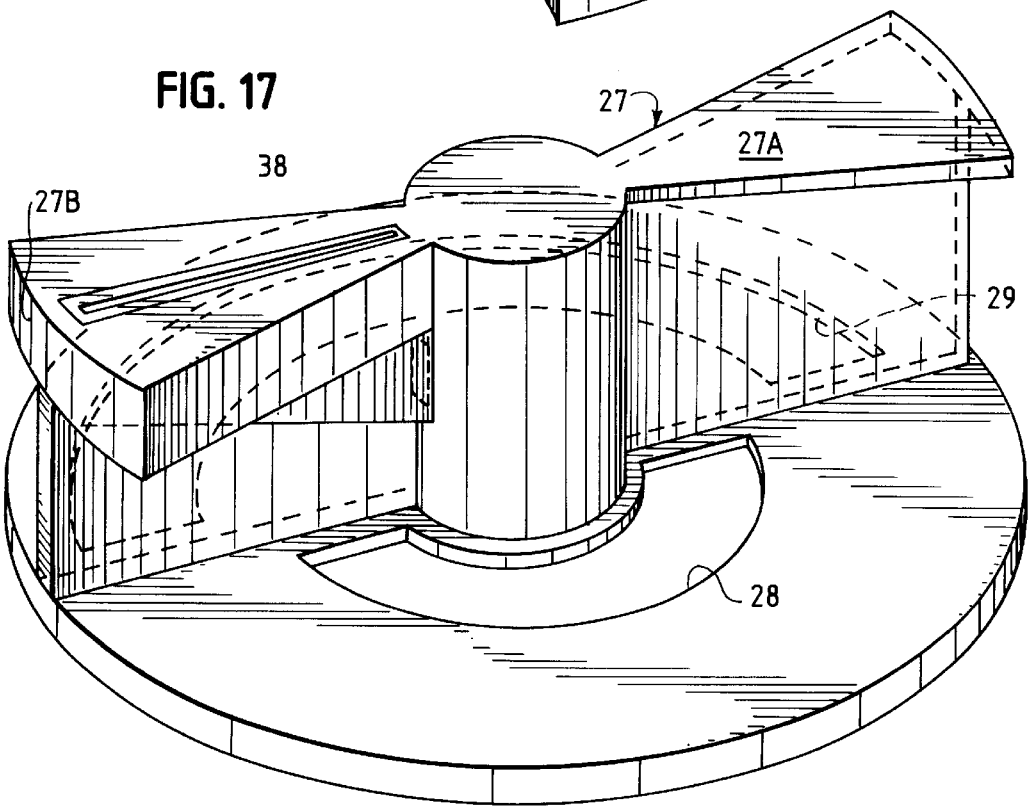
FIG. 17 is a side perspective view of an inner portion of the rotating valve.

Referring to FIGS. 1 and 5, in the preferred embodiment rotating plenum 20 includes a bowl-shaped lower plate with inner and outer arcuate openings 28 and 29, for receiving inlet and exhaust gas streams, respectively, from annular openings 120 and 130 of fixed plenum 30, respectively. Annular opening 120 is formed by concentric annular walls 120A, 120B, while annular opening 130 is formed by concentric annular walls 130A, 120B. Bowtie-shaped flow obstructor 27 includes a rectangular opening 38 in the leading edge of radially segmented section 17A. As shown in FIG. 16, the circumferential length of flow obstructor 27 is greater than the circumferential distances between adjacent radial walls 24. Section 27A of flow obstructor 27 has a trapezoidal-shaped depth, while section 27B may consist of a flat plate. Opening 38 is preferably relatively narrow to allow purge gas flowing through it (discussed below) to be maintained at a relatively high velocity.

Pressurized clean air is supplied from purge inlet 63 through central shaft 37A, and then through trapezoidal-shaped purge duct 27A. This pressurized air forms an air curtain which separates the untreated and treated gas streams within heat exchanger 13. It also purges the leading-edge radially extending heat exchanger section 17 which is not then communicating with the inlet or exhaust gas streams, forcing any remaining polluted gas within the heat exchanging beds into retention chamber 50, where it can be incinerated. This ensures that polluted gas will be cleansed from a heat exchanging bed prior to exposure of the gas within that bed to the atmosphere. Thus, the pressurized air through opening 38 acts as both a "sealing" gas and as a "purge" gas.

Referring to FIGS. 2 and 8–10, a circumferential sealing device also forms part of the present invention, and prevents process gas from leaking out the periphery of RTO 10 to the atmosphere. Spring steel seal 110, which may consist of a longitudinal ribbon or band of spring steel with slots, is bolted or otherwise connected to a peripheral portion of rotating plenum 20, while rigid L-shaped member 115 is welded or otherwise rigidly connected to a peripheral portion of base 98 of heat exchanger 13 so that seal 110 bears against rigid member 115 during movement of rotating plenum 20. This circumferential seal at the peripheral interface of rotating plenum 20 and fixed plenum 30 ensures that leakage through this interface will be minimized or eliminated.

Figure 2:
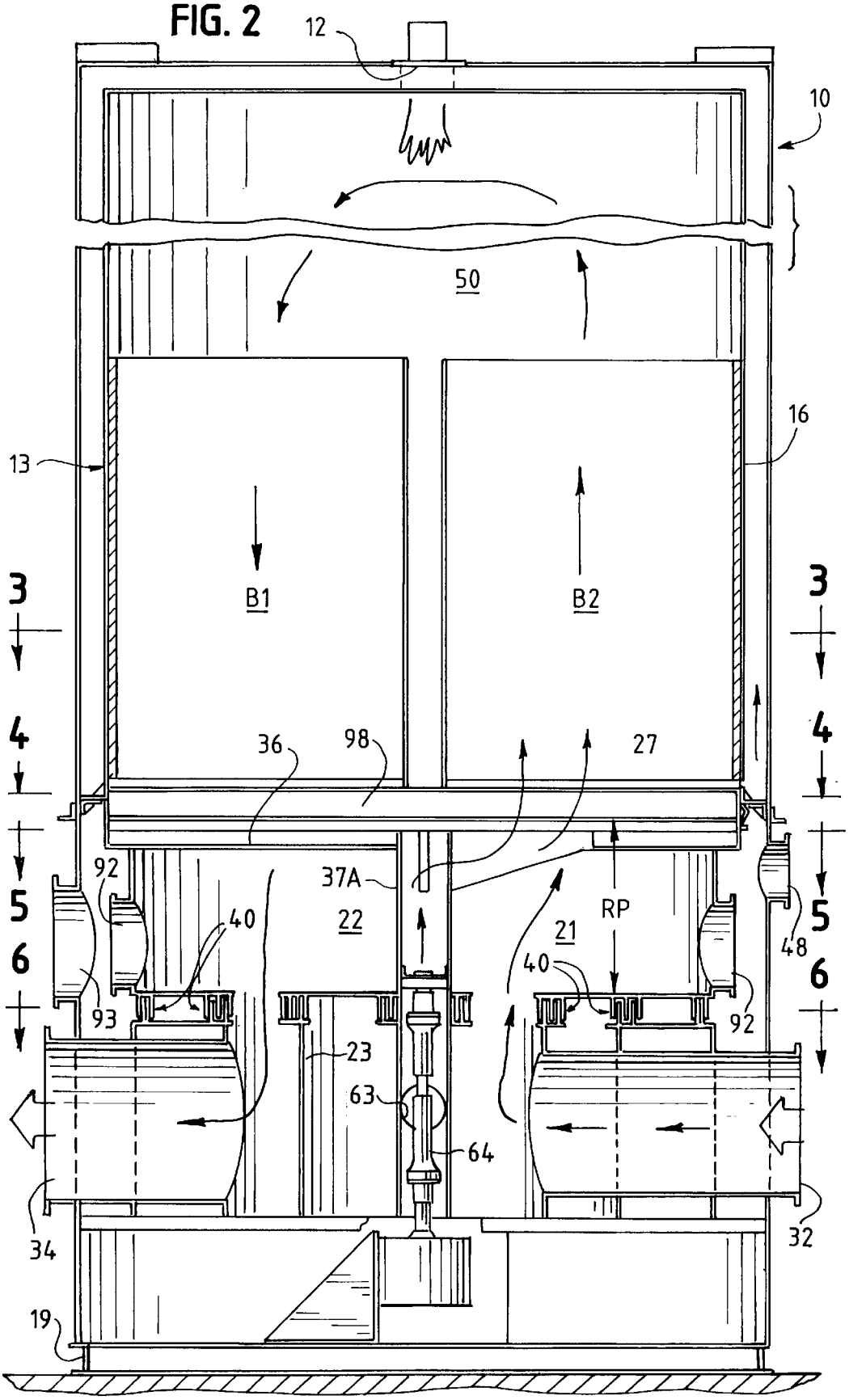
FIG. 2 is a side view along reference line 2—2 of FIG. 1.
Figure 7:
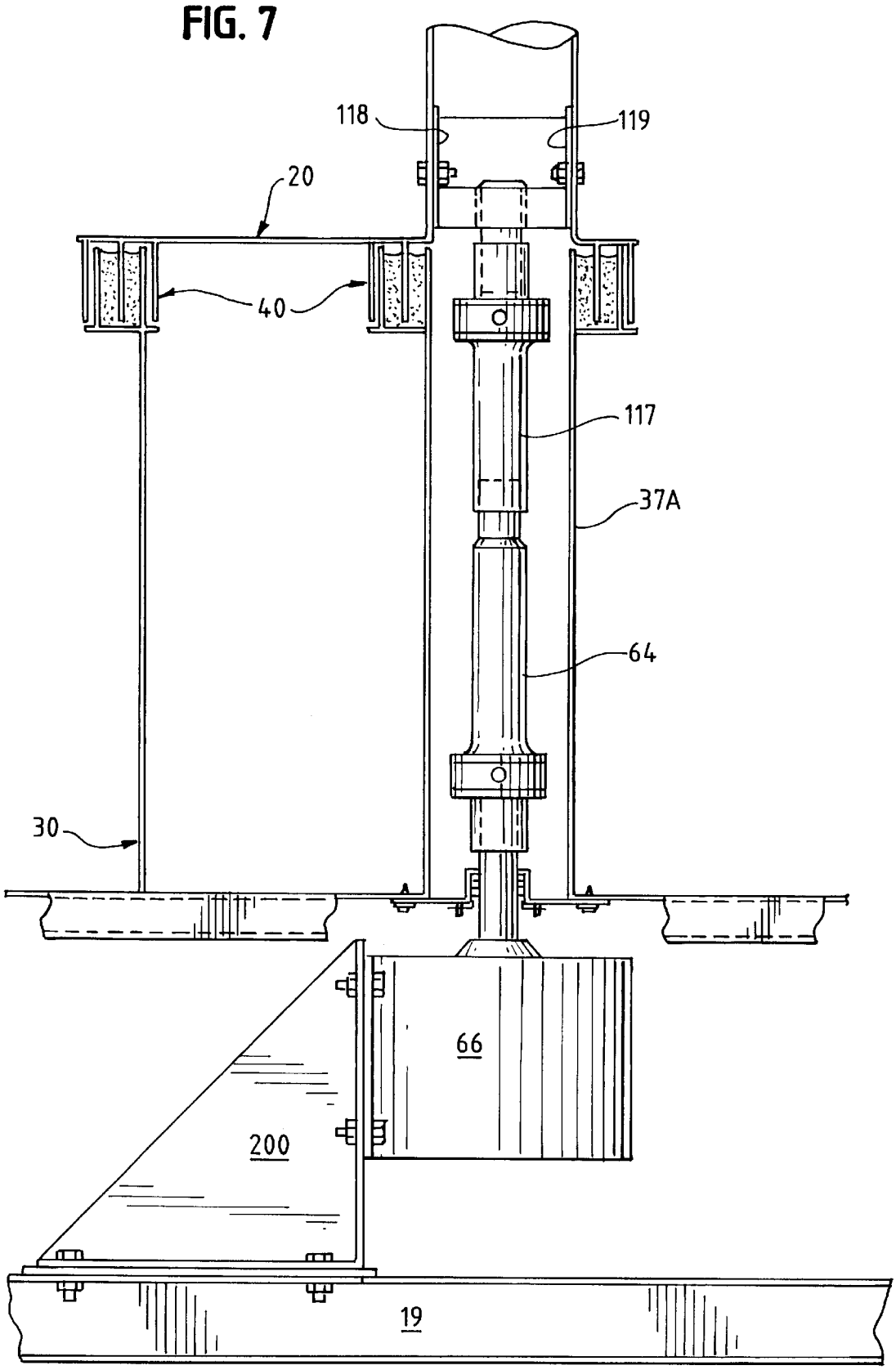
FIG. 7 is an enlarged view of the central shaft and rotary drive mechanism shown in FIG. 2.
Figure 8:
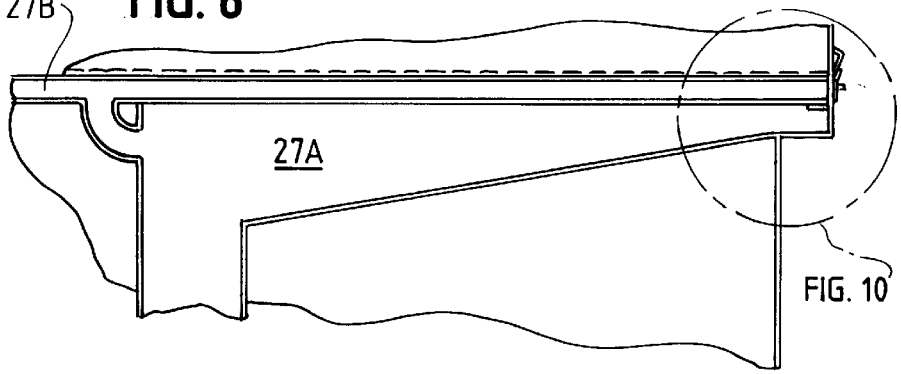
FIG. 8 is a sectional view along reference line 8—8 of FIG. 5.
Figure 9:
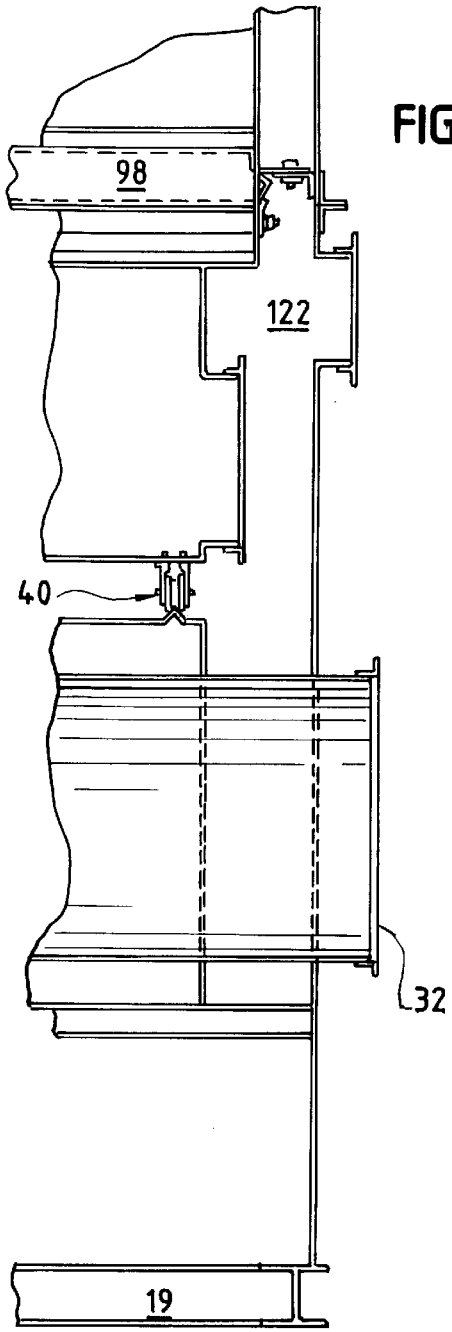
FIG. 9 is an enlarged view of the lower right side of FIG. 2.
Figure 10:
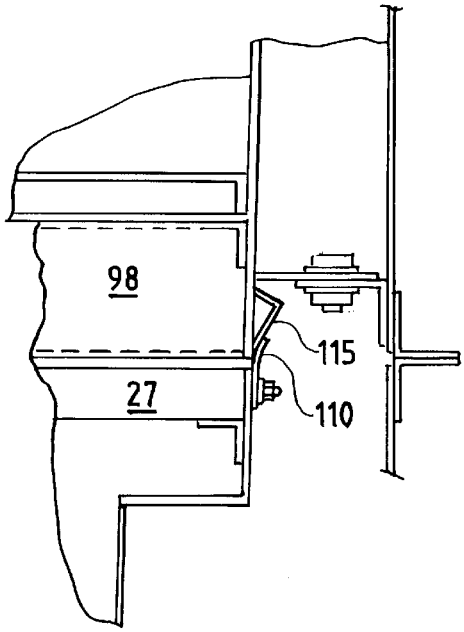
FIG. 10 is an enlarged view of the upper portion of FIG. 9, as well as the circled portion of FIG. 8.

Referring to FIGS. 2 and 9, clean sealing air maintained at a pressure greater than the process gas stream is also introduced into chamber 122. This sealing gas flows through the periphery of the RTO within hollow reactor housing 15, further minimizing the possibility of leakage of process gas through the reactor housing.

Figure 11:
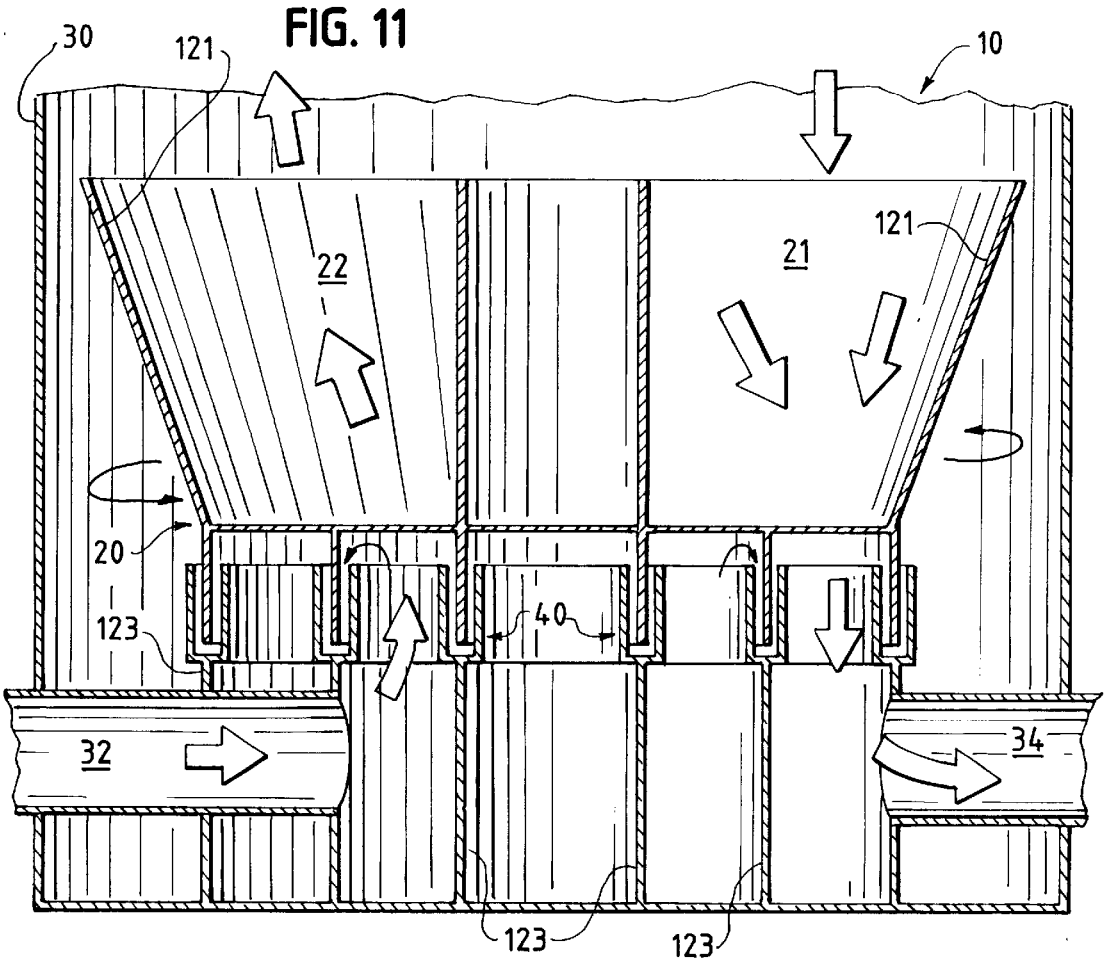
FIG. 11 is a perspective view of a lower portion of a simplied embodiment from the RTO shown in FIG. 1.
Figure 12:
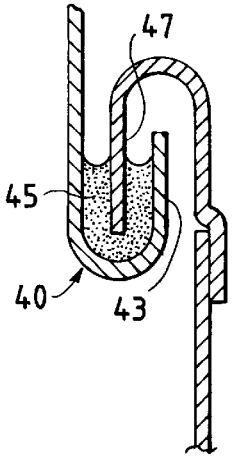
FIGS. 12–15 are enlarged cross-sectional views of alternative embodiments of interfacial seal 40 of the present invention.
Figure 13:
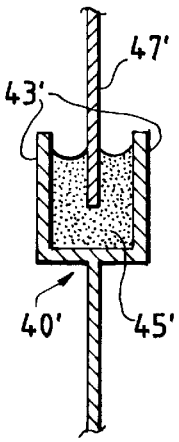

Referring now to FIGS. 12–15, preferred embodiments of the interfacial seal between the fixed and rotating plenums, generally designated as 40, are shown. In these embodiments, sealing device 40 includes a receptacle 43 containing a flowable sealing material 45. A circular blade or partition 47 is nested within receptacle 43. In alternative embodiments, receptacle 43, 43', 43" or 43'" may be either mounted to rotating plenum 20 (FIG. 12) or to fixed plenum 30 (FIGS. 11, and 13–15). In FIG. 11, receptacles 43 are attached to vertical walls 123 of fixed plenum 30, while circular blades 47 are attached to inclined walls 121 of rotating plenum 20. Receptacles 43 may have rectangular, circular, triangular or other suitable cross-sectional shapes.

Figure 14:
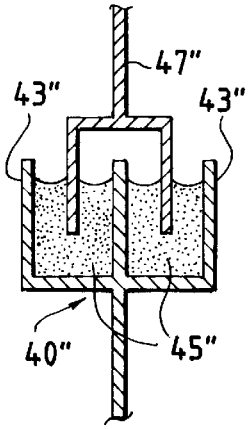
Figure 15:
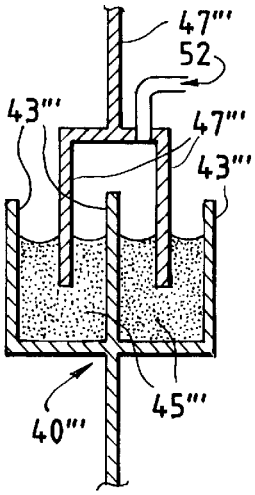

The configuration of interfacial sealing device 40 may be varied. For example, dual blades may be provided that ride in a split trough, as shown in FIGS. 14 and 15. This would create a double seal. Referring to FIG. 15, the seal could also be pressurized with compressed air or another gas, using line 52, to insure that any leakage moves in the proper direction.

Sealing material 45 may either be a liquid or a solid with fluid characteristics, Sealing material 45 must have a relatively high resistance to gas flow in order to eliminate or reduce gas leakage. It also must not volatilize or evaporate at the oxidation temperatures, and otherwise remain substantially inert in the presence of the process gases. Also, ideally, sealing material 45 is a low cost material which imparts little friction to the wear surfaces it contacts. Examples of sealing materials that might be used include sand, other granular materials, steel ball bearings, polished ceramic beds, small glass beads, greases, motor oils, or liquids such as water.

A preferred sealing material is an inert particulate, such as glass beads. When a particulate is used, the "effective depth" of the material is defined as twice the distance from the particulate's uppermost surface to the lower free end of the partition 47—in other words, the distance a gas must travel to pass through the particulate sealing material. For a given "effective depth" there is a maximum particle size that may not be exceeded in order to maintain the required pressure drop across the seal and to thereby achieve the desired sealing characteristics of the assembly. On the other hand, the minimum particle size of the sealing material is limited by the requirement that the particles not agglomerate in the presence of a high moisture content or humidity. In a particularly preferred embodiment, glass beads between about 1.0–1.7 millimeters in diameter were effectively used as the sealing material 45 in a seal design having an effective depth of about 8 inches.

Referring now to FIG. 16, a radial seal is also employed to prevent untreated gas from passing through the two radially segmented sections 17 over flow obstructor 27 and into sections 17 communicating with treated gas. In a preferred embodiment, the radial seal consists of flexible metallic (e.g., steel) wiper blades 167, which are attached to the bottom portions of radial walls 24. Use of this radial seal also ensures that the amount of purge gas required will be minimized due to the localized area which the purge gas thus occupies.

The sealing systems of the present invention may be employed with either continuous or indexing drive systems. Referring to FIG. 6, in a preferred embodiment a constant speed drive system is used, and includes drive shaft 64 within center shaft 37A. An upper portion of drive shaft 64 is attached to rotating plenum 20. Electric motor 66 is mounted to gusset 200 of fixed plenum 30, and powers the drive shaft 64. Motor 66 may be employed with a gear reducer. The drive shaft may be mounted rigidly to the rotating drive portion of the rotary assembly using plates 118, 119 bolted to center shaft 37A. Drive shaft preferably includes universal joint 117, to allow the rigidly mounted base (which is preferably steel fabricated, and not machined) to "flex" during rotation. Continuous movement of the rotary portion of the device minimizes the pressure fluctuations which may occur with an indexing rotary valve.

The present invention eliminates or reduces problems inherent with prior art designs. Thus, interfacial seal 40 need not be machined to tight tolerances. Instead, it may be fabricated to loose mechanical tolerances, given the nature of the seal. This makes the seal less expensive to fabricate and less prone to binding damage from uneven material growth due to temperature swings. Also, the use of purge gas or sealing air, to minimize cross-leakage at the fixed-rotation plenum interface and their related costs, may be unnecessary. Further, unlike past wiper seal designs, expense due to the replacement of worn seals and related parts is minimized. Maintenance costs are thus reduced, and the valves can be designed simpler and smaller since it is not believed that access to the seals and/or related replacement parts will be required on a periodic basis.

It has been found that, depending on the sealing material selected, gas leakage can be reduced to virtually zero. In fact, testing indicates that a leak rate of less than 0.1%, and preferably less than 0.05% (about 0.04%) of the untreated gas through the interfacial seal to the oxidation chamber can be provided (based upon the total flow through the RTO). This smaller-scale testing was done in which there was 30 inches of water column differential pressure between the inlet and outlet gas stream (which is the resistance to flow that the heat exchange media provides). This is particularly advantageous when the required destruction efficiency is high. In the past, a substantially "zero-leakage" seal would have required expensive machined components together with the use of sealing "purge" air.

In short, the valve sealing device of the present invention does not require close tolerances, sealing air, or replacement wear surfaces to achieve a substantially leak-proof seal in a rotary application.

It will be understood that the invention may be embodied in other specific forms without departing from its spirit or central characteristics. For example, those of ordinary skill in the art will understand from this disclosure that the present invention may be used to advantage with other multi-chambered thermal oxidizers such as regenerative catalytic oxidizers. The present examples and embodiments, therefore, are to be considered in all respects as illustrative and not restrictive, and the invention is not to be limited to the details given here.

We claim:

1. A regenerative thermal oxidizer, comprising:

a combustion chamber;

a heat exchanger having a plurality of heat exchanging segments communicating with the combustion chamber;

a gas stream distribution assembly including a fixed plenum having an untreated gas stream inlet and a treated gas stream outlet, and a rotating plenum disposed between the fixed plenum and the heat exchanger;

the rotating plenum permitting the conveyance of the untreated gas stream from the inlet to selective heat exchanger segments, and also permitting the conveyance of the treated gas stream from other selective heat exchanger segments to the outlet; and a seal disposed at an interface between the fixed and rotating plenums to reduce mixing of the treated and untreated gases, the seal comprising at least one annular receptacle containing a sealing material and a partition nested within the receptacle and engaging the sealing material.

2. The regenerative thermal oxidizer of claim 1, wherein the sealing material is substantially inert with respect to the treated and untreated gas streams.

3. The regenerative thermal oxidizer of claim 1, wherein the sealing material is generally free-flowing and is composed of particles having a size sufficient to minimize agglomeration of the particles when exposed to gas streams having an elevated moisture content.

4. The regenerative thermal oxidizer of claim 1, wherein the sealing material has an effective depth and is composed of particles having a maximum particle size sufficient to substantially prevent passage of the gas stream.

5. The regenerative thermal oxidizer of claim 1, wherein the sealing material comprises sand.

6. The regenerative thermal oxidizer of claim 1, wherein the sealing material comprises glass beads.

7. The regenerative thermal oxidizer of claim 1, wherein the seal employs components that are not machined.

8. The regenerative thermal oxidizer of claim 1, wherein the total amount of leakage of the untreated process gas is equal to or less than about 0.1% of the total flow of gas through the regenerative thermal oxidizer.

9. The regenerative thermal oxidizer of claim 1, wherein the partition is associated with the rotating plenum and the receptacle is associated with the fixed plenum.

10. The regenerative thermal oxidizer of claim 1, wherein the partition is associated with the fixed plenum and the receptacle is associated with the rotating plenum.

11. The regenerative thermal oxidizer of claim 1, wherein the rotating plenum moves continuously with respect to the fixed plenum.

12. The regenerative thermal oxidizer of claim 1, wherein the heat exchanger segments are defined by radial walls, and the rotating plenum includes a gas flow obstruction assembly having a diametric partition, and further comprising radially extending seals depending from the radial walls that are in wiping engagement with the diametric partition.

13. The regenerative thermal oxidizer of claim 1, wherein the rotating plenum includes a circumferential outer wall having a peripheral lip, and further comprising a sliding seal engaging the peripheral lip and preventing untreated gas from leaking outside the peripheral interface of the rotating and fixed plenums.

14. The regenerative thermal oxidizer of claim 1, further comprising a purge gas passageway communicating with a portion of the rotating plenum, so that a separating gas curtain is provided between adjacent treated and untreated gas streams.

15. A regenerative thermal oxidizer, comprising:

a combustion chamber;

a heat exchanger having a plurality of heat exchanger segments communicating with the combustion chamber;

a gas stream distribution assembly including a fixed plenum in communication with an untreated gas stream inlet and a treated gas stream outlet, and a rotating plenum disposed between the fixed plenum and the heat exchanger;

the rotating plenum permitting the conveyance of the untreated gas stream from the fixed plenum to selective heat exchanger segments, and also permitting the conveyance of the treated gas stream from other selective heat exchanger segments to the fixed plenum;

a seal disposed at an interface between the fixed and rotating plenums, the seal including an annular receptacle containing a sealing material, and a partition nested within the receptacle and engaging the sealing material; and wherein the heat exchanger segments are defined by radial walls, and the rotating plenum includes a gas flow obstruction assembly having a diametric partition, and further comprising radially extending seals depending from the radial walls that are in wiping engagement with the diametric partition.

16. A regenerative thermal oxidizer, comprising:

a combustion chamber;

a heat exchanger having a plurality of heat exchanger segments communicating with the combustion chamber;

a gas stream distribution assembly including a fixed plenum in communication with an untreated gas stream inlet and a treated gas stream outlet, and a rotating plenum disposed between the fixed plenum and the heat exchanger;

the rotating plenum permitting the conveyance of the untreated gas stream from the fixed plenum to selective heat exchanger segments, and also permitting the conveyance of the treated gas stream from other selective heat exchanger segments to the fixed plenum;

a seal disposed at an interface between the fixed and rotating plenums, the seal including an annular receptacle containing a flowable sealing material, and a partition nested within the receptacle and engaging the sealing material;

wherein the heat exchanger segments are defined by radial walls, and the rotating plenum includes a gas flow obstruction assembly having a diametric partition, and further comprising radially extending seals depending from the radial walls that are in wiping engagement with the diametric partition; and further comprising a purge gas passageway communicating with a portion of the rotating plenum and permitting pressurized purge gas pass through selective heat exchanger segments and to form a separating gas curtain between adjacent treated and untreated gas streams.

17. The regenerative thermal oxidizer of claim 16, wherein the purge gas is supplied under positive pressure.

18. The regenerative thermal oxidizer of claim 17, wherein the purge gas is supplied under negative pressure.

19. A thermal oxidizer, comprising:

a combustion chamber;

a heat exchanger having a plurality of heat exchanger segments communicating with the combustion chamber;

a gas stream distribution assembly including a fixed plenum in communication with an untreated gas stream inlet and a treated gas stream outlet, and a rotating plenum disposed between the fixed plenum and the heat exchanger;

the rotating plenum permitting the conveyance of the untreated gas stream from the fixed plenum to selective heat exchanger segments, and also permitting the conveyance of the treated gas stream from other selective heat exchanger segments to the fixed plenum;

a seal disposed at an interface between the fixed and rotating plenums, the seal including an annular receptacle containing a flowable sealing material, and a partition nested within the receptacle and engaging the sealing material.

20. The thermal oxidizer of claim 19, wherein the thermal oxidizer comprises a catalytic thermal oxidizer.

* * * * *